US005332454A

United States Patent [19]

Meredith et al.

[11] Patent Number: 5,332,454

[45] Date of Patent: * Jul. 26, 1994

[54] TITANIUM OR TITANIUM BASED ALLOY CORROSION RESISTANT TUBING FROM WELDED STOCK

[75] Inventors: Steven E. Meredith; James F. Benjamin, both of Kennewick, Wash.

[73] Assignee: Sandvik Special Metals Corporation, Kennewick, Wash.

[ * ] Notice: The portion of the term of this patent subsequent to Jul. 13, 2010 has been disclaimed.

[21] Appl. No.: 28,153

[22] Filed: Mar. 9, 1993

Related U.S. Application Data

[63] Continuation of Ser. No. 826,876, Jan. 28, 1992, Pat. No. 5,226,981.

[51] Int. Cl.[5] ..... C22C 14/00

[52] U.S. Cl. ..... 148/421; 148/520; 148/670; 148/671

[58] Field of Search ..... 148/520, 670, 671, 421

[56] References Cited

U.S. PATENT DOCUMENTS

| | | | |
|---|---|---|---|
| 3,486,219 | 12/1969 | Davies et al. | 29/580 |
| 3,969,155 | 7/1976 | McKeighen | 148/670 |
| 4,690,716 | 9/1987 | Sabol et al. | 148/521 |
| 4,717,428 | 1/1988 | Comstock et al. | 148/672 |
| 4,726,852 | 2/1988 | Nakanose et al. | 148/670 |
| 4,728,491 | 3/1988 | Reschke et al. | 148/672 |
| 4,765,174 | 8/1988 | Cook et al. | 420/422 |
| 4,802,930 | 2/1989 | Kessler | 148/671 |
| 4,878,966 | 11/1989 | Alhertiere et al. | 148/671 |
| 4,990,305 | 2/1991 | Foster et al. | 148/672 |
| 5,039,356 | 8/1991 | Weiss et al. | 148/670 |

FOREIGN PATENT DOCUMENTS

| | | | |
|---|---|---|---|
| 4019117 | 12/1991 | Fed. Rep. of Germany | C22C 14/00 |
| 2204061 | 11/1988 | United Kingdom | C22C 14/00 |

OTHER PUBLICATIONS

Ardenton et al in Ti and Ti-Alloys, vol. 2, eds. Williams et al, Plenum, N.Y. p. 1139.

*Primary Examiner*—Upendra Roy

*Attorney, Agent, or Firm*—Burns, Doane, Swecker & Mathis

[57] ABSTRACT

A method of manufacturing corrosion resistant tubing from seam welded stock of a titanium or titanium alloy metallic material having a hexagonal close-packed crystal structure. The method includes cold pilgering a seam welded tube hollow having a weld area along the seam in a single pass to a final sized tube. The cold pilgering effects a reduction in cross sectional area of the tube hollow of at least 50% and a reduction of wall thickness of at least 50% thereby orienting the crystals in a radial direction. The method also includes annealing the final sized tubing at a temperature and for a time sufficient to effect complete recrystallization and reform grains in the weld area into smaller, homogeneous radially oriented grains. After the recrystallization annealing step, the tubing exhibits enhanced corrosion resistance which is similar to seamless tubing.

8 Claims, 1 Drawing Sheet

TITANIUM OR TITANIUM BASED ALLOY CORROSION RESISTANT TUBING FROM WELDED STOCK

This application is a continuation of application Ser. No. 07/826,876, filed Jan. 28, 1992, now U.S. Pat. No. 5,226,981.

BACKGROUND OF THE INVENTION

1. Field of the Invention

The invention relates to the production of corrosion resistant tubing from welded starting material of metals such as titanium and alloys thereof, having a hexagonal close packed crystal structure at room temperature.

2. Description of Related Art

It is a recognized fact that tubing made by rolling flat stock and welding is less expensive than tubing made by a seamless technique. For instance, it is quite common to use welded tubing for commercial applications such as chemical process tubing which do not require the additional quality that seamless tubing provides. However, there are certain environments where corrosion problems can occur preferentially along the weld seam. This has been observed in titanium as well as in zirconium alloy tubing made for the nuclear industry. These weld seam corrosion problems are due to the large, random grain structure inherent in welded materials. Weld seam corrosion can proceed to the point where the weld seam will fail and open up like a "zipper" under pressure.

A major reason for corrosion problems along the weld seam is due to the formation of metal hydrides. Titanium, zirconium and certain other metals have a susceptibility to hydrogen contamination and under certain circumstances, hydrides form which are by nature very brittle. Cracks which may be present at tube surfaces, will follow along these hydrides when stresses are applied. Therefore, the orientation of the hydrides to the tube wall is very important. If the hydrides are oriented across the tube wall, then there is a very short path for a stress corrosion crack to follow and cause rupture of the tube. However, if the hydrides are oriented in a circumferential direction, then there is no easy path for cracks to follow and no rupture will occur.

It has been shown that the orientation of the metallic crystals determine the orientation of hydrides. Tubing with a "radial" crystallographic texture is oriented such that hydrides are circumferential and do not pose a significant problem. In a welded tube, the base metal may have a radial orientation left over from the strip rolling process. In the weld seam, however, the crystals are very large and random. Some of these large crystals will be oriented in the circumferential direction and hydrides will form within these crystals across the tube wall and cause premature rupture of the tube. This corrosion phenomena is called "delayed hydrogen cracking" (DHC).

U.S. Pat. No. 3,486,219 ("Davies") discloses a method of homogenizing the structure of butt welded tubes useful for nuclear energy applications by cold planetary ball swaging to deform the grain structure and subsequently heat treating to effect recrystallization of the structure. Davies provides examples of preparing tubes of stainless steel and Zircaloy-2. Davies does not disclose making tubes of titanium or titanium alloys.

U.S. Pat. No. 4,765,174 ("Cook") relates to production of tubing of zirconium and alloys thereof. In particular, Cook discloses that it is conventional to subject Zircaloy tubing to multiple pilger reductions and intermediate recrystallization anneals with Q ratios greater than 1, especially in the last or final pilger reduction, in order to produce a textured Zircaloy product resistant to radial hydride formation in service (Column 1, lines 26–68 of Cook). According to Cooks's invention, hot extruded Zircaloy tubing is expanded to enhance radial texturing of the tubing. Cook does not disclose making tubes of titanium or titanium alloys.

U.S. Pat. No. 4,990,305 ("Foster") relates to textured zirconium tubing. In particular, Foster discloses that it is conventional to subject tubing made of zirconium alloys to mechanical and thermal treatments and that pilgering causes the hydrides in the tubing material to be oriented in a circumferential direction (Column 1, lines 14–27 of Foster). According to Foster's patent, tubing is processed in steps to a diameter 10–20% smaller than the final diameter and then subjected to an expansion treatment and anneal to produce a single peak radial texture. Foster does not disclose making tubes of titanium or titanium alloys.

U.S. Pat. No. 4,690,716 ("Sabol") relates to preparation of tubing from a temperatures of at least 1250° F. an example of Zircaloy tubing formed by welding the confronting ends of a rolled sheet together to form a precursor tubing (Column 3, lines 37–40 of Sabol). Sabol discloses a process for producing a homogenous structure by rapidly heating successive axial segments of the welded tubing completely through the wall to transform the material into the beta phase, rapidly cooling the beta phase tubing, and then subsequently deforming the quenched tubing, by cold working, to produce a final tube (Column 3, lines 52–59 of Sabol). Sabol discloses that the cold working may be effected in a single stage or in a plurality of stages with intermediate recrystallization anneals between each of the plurality of stages and the final size material can be subjected to either a recrystallization or stress relief anneal (Column 4, lines 55–65 of Sabol). Sabol discloses that the cold working may be effected by drawing of the tube or a cold working step, such as pilgering, which will reduce the area of the tubing at least 30% or more (Paragraph bridging columns 4–5 of Sabol). According to Sabol's invention, the precursor welded tubing is heated into the beta phase and quenched in order to produce a homogenous structure throughout the final tubing (Column 3, lines 42–59 of Sabol).

U.S. Pat. No. 4,717,428 ("Comstock") relates to annealing cold pilgered zirconium base tubing. In particular, Comstock discloses that it is conventional to machine a hollow Zircaloy billet, extrude the billet into an extrusion and subject the extrusion to a number of cold pilger reduction passes with about 50–85% reduction per pass with an alpha recrystallization anneal prior to each pass (Column 1, lines 47–57 of Comstock). Comstock's invention relates to a process for rapid alpha annealing of zirconium based articles rather than the conventional alpha vacuum anneals (Column 4, lines 47–50 of Comstock). Comstock does not disclose making tubes of titanium or titanium alloys.

U.S. Pat. No. 4,728,491 ("Reschke") relates to cladding tube of a zirconium alloy. In particular, Reschke discloses a process of making cladding tubes of a zirconium alloy which are resistant to stress corrosion (Column 1, lines 48–50 of Reschke). Reschke discloses pilger-rolling a starting tube to obtain a cross-section change of the tube wall of 90% or more and produce a finished cladding tube without recrystallization annealing and free of cracks (Column 1, lines 62–66 of Reschke). Reschke discloses that it is advantageous to pilger roll the tube in steps and stress-anneal the tube between two pilger roll passes (Column 2, lines 58–60 of Reschke). Reschke does not disclose making tubes of titanium or titanium alloys.

There is a need in the art for an economical process of making corrosion resistant titanium or titanium alloy tubing from welded stock. Such tubing should possess a homogeneous microstructure with a radial crystallographic texture which is not preferentially attacked by corrosion along the weld seam.

SUMMARY OF THE INVENTION

The invention provides a method of manufacturing corrosion resistant titanium or titanium alloy tubing from seam welded stock. The method includes cold pilgering a seam welded tube hollow having a weld area along the seam in a single pass to a final sized tube. The cold pilgering effects a reduction in cross sectional area of the tube hollow of at least 50% and a reduction of wall thickness of at least 50% in such a manner as to reorient grains in a radial direction. The method includes annealing the final sized tubing at a temperature and time sufficient to effect complete recrystallization and reform grains in the weld area into a more refined homogeneous microstructure.

In accordance with various aspects of the invention, the material can be commercially pure titanium or alloys such as Ti-6Al-4 V and Ti-3Al-2.5 V. The cold pilgering preferably with a high Q pass wherein Q represents the ratio of reduction in wall thickness to the reduction in mean outer diameter of the tube hollow. In order to provide enhanced radial texturing, Q should preferably be at least 1. The cold pilgering can effect reductions in cross sectional area and the wall thickness of at least 60% or at least 70%. The tube hollow preferably comprises a rolled sheet or strip which has been welded along opposite edges thereof, the welded tube hollow having a heterogeneous microstructure in the weld area. The annealing preferably avoids grain growth and can be performed by induction heating or by heating the final sized tube in a vacuum furnace or in a continuous atmosphere furnace. In the case of commercially pure Ti, the annealing can be performed at temperatures of at least 1100° F. and in the case of Ti-6Al-4 V, the annealing can be performed at temperatures of at least 1400° F. In the case of Ti-3Al-2.5 V, the annealing can be performed at temperatures of at least 1250° F.

DETAILED DESCRIPTION OF THE INVENTION

The invention provides a process which takes a welded tube and then refines and reorients the grains in the weld seam to form a homogeneous, radially textured microstructure. Tubing made from this process is resistant to corrosion and delayed hydride cracking. The performance of this tubing is as good and in some cases better than seamless tubing. The invention is particularly advantageous in producing hydraulic tubing of titanium and titanium alloys.

The invention provides a process for producing a radially textured, homogeneous product from a welded tube starting material. The welded tube hollow is cold reduced on a pilger machine with a large area reduction (<50%) accompanied by a large reduction in wall thickness (<50%). However, it may be possible to achieve the desired radial texture by reduction processes other than cold pilgering. The tube is annealed to provide a uniform, fine-grained microstructure so as to recrystallize the original weld seam. The high "Q" pass (the ratio of wall reduction to mean OD reduction) in the final pass produces a radial crystallographic texture which enhances corrosion resistance particularly with regard to hydride orientation.

According to the invention, a seam welded tube is cold pilgered over a stationary, tapered mandrel, by means of two similar tapered dies, which roll back and forth over the material. The ingoing tube is rotated and advanced forward a small increment at the beginning of each stroke. The tube diameter and wall are continuously reduced during each small increment of forward advancement. This process inputs a large amount of cold work, greater than 50% reduction in area, into the material. After subsequent annealing at temperatures high enough to cause recrystallization of the material, the original weld seam has transformed into an area which has a highly refined and uniform microstructure.

Figure 1:
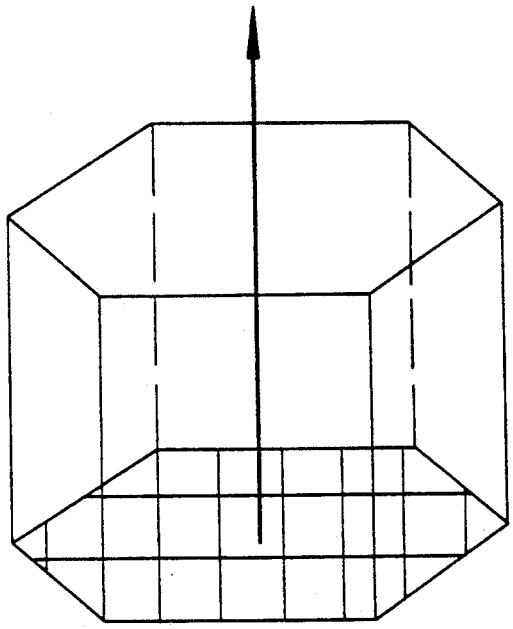
FIG. 1 shows a schematic representation of the basal plane of a hexagonal close packed crystal.
Figure 2:
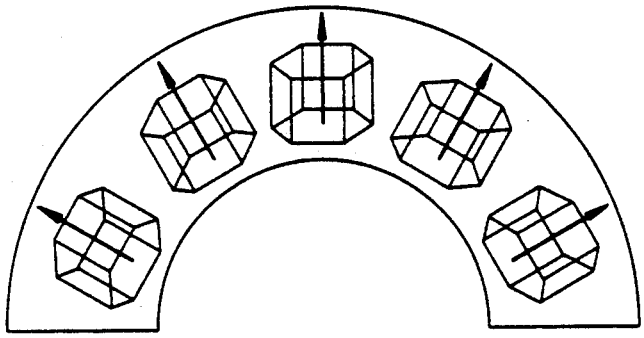
FIG. 2 shows a schematic representation of the basal pole orientation of radially textured tubing.
Figure 3:
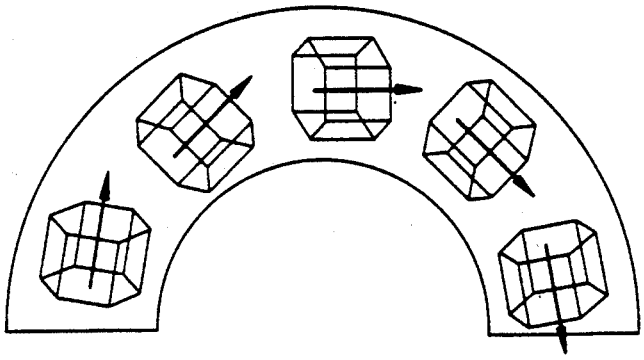
FIG. 3 shows a schematic representation of the basal pole orientation of tangentially textured tubing.

To produce a finished tube with the preferred radial texture, it is necessary to control the amount of diameter and wall reduction during forming. The ratio of wall reduction to mean diameter reduction is termed the "Q" value. A reduction with a high Q value tends to orient the hexagonally close packed crystals (as shown in FIG. 1) such that their basal poles are in the radial direction, as shown in FIG. 2. Conversely, a low Q value (less than one) tends to orient the crystals in the circumferential or tangential direction, as shown in FIG. 3.

EXAMPLE

As an example, a commercially pure titanium welded tube can be produced by cold pilgering a precursor welded tube stock having 2.375 inch outer diameter and 0.109 inch wall thickness directly to 2.00 inch final outer diameter and 0.036 inch final wall thickness. After cold pilgering, the tube is subjected to recrystallization annealing. The welded tube stock is made from a fully annealed strip which has been bent into a tube shape and welded along opposed edges of the strip. The welded tube stock can then be given a stress relief anneal prior to the cold pilgering and recrystallization annealing steps.

X-ray diffraction tests performed on titanium tubing produced according to the invention confirm that a radial texture is produced in both the original weld area and the rest of the tube. Texture tests on welded tube samples show that the weld seam contains a random orientation of crystals. Hydride tests have shown that in the welded tube samples, hydrides to indeed orient themselves directly across the tube wall. Tubing samples made according to the invention have a much finer and radially oriented hydride orientation as compared to the welded samples. Corrosion studies also show that the tubing made according to the invention outperforms welded tubing and is similar to seamless tubing.

As far as annealing parameters are concerned, the main idea is to provide a complete recrystallization anneal after the material has been reduced. This allows the grains in the weld area to reform into smaller, radially oriented grains. In the above example, annealing was performed in a vacuum furnace at 1200° F. nominal temperature for one hour. Heat-up and cooling was fairly slow (3–4 hours), which is typical of this type of furnace. For commercially pure titanium, however, heating and cooling rates do not make any difference since there is only one phase present and other types of furnaces, including induction heating or continuous atmosphere furnaces, could be used. Heating and cooling rates become important with two phase "alpha+-beta" alloys.

The main annealing variables are time and temperature with temperature being the most important. The temperature must be sufficiently high to allow recrystallization to occur in a reasonable length of time. The higher the temperature, the quicker recrystallization occurs, although at too high a temperature, grain growth can become a problem. The recrystallization temperature (Tr) will vary for different materials and different levels of cold working. For tubing heavily cold worked, the Tr ranges from about 1100° F. for commercially pure titanium to about 1400° F. for Ti-6Al-4 V and about 1250° F. for Ti-3Al-2.5 V.

The preferred titanium alloys useful in the process of the invention include alpha and alpha+beta alloys. For instance, the Ti based alloys can include 5.5 to 6.5 wt. % Al and 3.5 to 4.5 wt. % V or 2.5 to 3.5 wt. % Al and 2 to 3 wt. % V.

While the invention has been described with reference to the foregoing, various changes and modifications can be made thereto which fall within the scope of the appended claims.

What is claimed is:

1. A seam welded tube of titanium or titanium based alloy having a longitudinally extending weld seam, a radially oriented crystallographic texture throughout the tube an a completely recrystallized grain structure in a weld area along the weld seam.

2. The tube of claim 1, wherein the tube comprises a rolled sheet having opposed edges thereof welded together.

3. The tube of claim 1, wherein the tube comprises commercially pure Ti.

4. The tube of claim 1, wherein the tube comprises a titanium based alloy having 5.5 to 6.5 wt. % Al and 3.5 to 4.5 wt. % V.

5. The tube of claim 1, wherein the tube comprises a titanium based alloy having 2.5 to 3.5 wt. % Al and 2 to 3 wt. % V.

6. The tube of claim 1, wherein the tube is resistant to delayed hydride cracking.

7. The tube of claim 1, wherein the tube has been subjected to cold pilgering followed by recrystallization annealing.

8. A seam welded tube of titanium or titanium based alloy having a longitudinally extending weld seam, a radially oriented crystallographic texture throughout the tube and a completely recrystallized grain structure in a weld area along the weld seam, the tube comprising a seam welded tube hollow which has been cold pilgered in a single pass to a final size such that the tube hollow was reduced in cross sectional area by at least 50% and the tube hollow was reduced in wall thickness by at least 50%.

* * * * *

UNITED STATES PATENT AND TRADEMARK OFFICE

CERTIFICATE OF CORRECTION

PATENT NO. : 5,332,454

DATED : July 26, 1994

INVENTOR(S) : Meredith et al.

It is certified that error appears in the above-indentified patent and that said Letters Patent is hereby corrected as shown below:

Column 4, line 10, change "(< 50%)" to --( >50%)--;

line 11, change "(< 50%)" to --( >50%)--.

Signed and Sealed this

Sixth Day of December, 1994

*Attest:*

*Attesting Officer*

BRUCE LEHMAN

*Commissioner of Patents and Trademarks*